United States Patent [19]

Suwa

[11] Patent Number: 4,838,319

[45] Date of Patent: Jun. 13, 1989

[54] APPARATUS AND METHOD FOR STARTING A JET LOOM

[75] Inventor: Mituru Suwa, Kanazawa, Japan

[73] Assignee: Tsudakoma Kogyo Kabushiki Kaisha, Japan

[21] Appl. No.: 209,436

[22] Filed: Jun. 21, 1988

Related U.S. Application Data

[63] Continuation-in-part of Ser. No. 934,731, Nov. 25, 1986.

[30] Foreign Application Priority Data

Jan. 29, 1986 [JP] Japan ..... 61-019025

[51] Int. Cl.[4] ..... D03D 47/08

[52] U.S. Cl. ..... 139/116 R; 139/450; 139/370.2

[58] Field of Search ..... 139/1 R, 1 E, 116, 450, 139/452, 370.1, 370.2

[56] References Cited

U.S. PATENT DOCUMENTS 3,805,850 4/1974 Van Duynhoyen et al. .
4,502,512 3/1985 Suzuki et al. .
4,620,570 11/1986 Suzuki et al. ..... 139/116
4,781,221 11/1988 Onishi et al. ..... 139/116

*Primary Examiner*—Henry S. Jaudon
*Attorney, Agent, or Firm*—Lerner, David, Littenberg, Krumholz & Mentlik

[57] ABSTRACT

Apparatus and method for removing a faulty weft from the shed of a jet loom upon stoppage of the loom and for restarting the loom thereafter. A mechanism generates a detection signal upon detecting the presence of the delivery of weft from a supply source upon removal of a faulty weft from the shed upon activation of a weft removal unit. The loom is allowed to be restarted after complete removal of the faulty weft from the shed and only upon confirming the presence of the detection signal.

11 Claims, 2 Drawing Sheets

APPARATUS AND METHOD FOR STARTING A JET LOOM

BACKGROUND OF THE INVENTION

This is a continuation-in-part application of copending application Ser. No. 934,731 filed on Nov. 25, 1986.

The present invention relates to an apparatus and method for starting a jet loom, and more particularly, to an improvement in an apparatus and in a process of restarting a jet loom having the function of auto-repair of weaving defects after stoppage due to accidental events, such as weft breakage and the like.

After repair of weaving defects, a jet loom is restarted for continued production. For successful restarting of the loom, a weft in the main nozzle has to be correctly connected to an associated weft supply source. In other words, interruption in the weft supply will prevent continuous supply of weft to the main nozzle and ultimately successful restarting of the loom.

Conventionally, the presence of this interruption in weft supply is confirmed by visual observation by an operator. The loom is restarted only when the absence of interruption in the weft supply has been confirmed. This confirmation must be carried out every time the loom has stopped and, as a consequence, greatly reduces operation efficiency and increases labor for the visual observation, thereby raising total production cost. Also, on a jet loom having the function of auto-repair of weaving defect, such confirmation of the presence of the non-interruption in the weft supply is indispensable in order to obviate operational problems after restart of the loom. There is presently unknown an apparatus or method for the automatic confirmation of the presence of the non-interruption in weft supply prior to restarting of a jet loom.

When weft reservation is carried out using a reservoir drum, residual weft on the reservoir drum has to be removed concurrently with the removal of a faulty weft from the shed. This is because the residual weft is not always long enough for one cycle of weft insertion. When a residual weft of an insufficient length is used for weft insertion after restarting of the loom, unavoidable faulty weft insertion causes instant stoppage of the loom once again, thereby greatly lowering the running efficiency of the loom.

SUMMARY OF THE INVENTION

It is a basic object of the present invention to enable automatic detection of the absence of the interruption in the weft supply, as well as the absence of a residual weft in a weft reservoir in advance of restarting of the loom after stoppage due to operational difficulties.

In accordance with one embodiment of the present invention there is discussed a method of removing a faulty weft from a shed of a jet loom upon stoppage of the loom and of restarting the loom thereafter; the loom having a supply source of weft to be delivered therefrom, a main nozzle for inserting the weft delivered from the supply source into the shed, and a weft removal unit for removing a faulty weft from the shed upon activation thereof prior to severing the faulty weft from the supply source, the improvement comprising: generating a detection signal upon detecting the presence of the delivery of the weft from the supply source upon removal of the faulty weft from the shed upon activation of the weft removal unit, and allowing restarting of the loom after complete removal of the faulty weft from the shed upon confirming the presence of the detection signal.

In accordance with another embodiment of the present invention there is disclosed an apparatus for removing a faulty weft from a shed of a jet loom upon stoppage of the loom and for restarting the loom thereafter; the loom having a supply source of weft to be delivered therefrom, a main nozzle for inserting the weft delivered from the supply source into the shed, and a weft removal unit for removing a faulty weft from the shed upon activation thereof prior to severing the faulty weft from the supply source, the improvement comprising: means for generating a detection signal upon detecting the presence of the delivery of the weft from the supply source upon removal of the faulty weft from the shed upon activation of the weft removal unit, and means for allowing restarting of the loom after complete removal of the faulty weft from the shed upon confirming the presence of the detection signal.

BRIEF DESCRIPTION OF THE DRAWINGS

The above description, as well as further objects, features and advantages of the present invention, will be more fully understood by reference to the following detailed description of a presently preferred, but nonetheless illustrative, an apparatus and method for starting a jet loom, in accordance with the present invention, when taken in conjunction with the accompanying drawing, wherein.

DETAILED DESCRIPTION

Figure 1:
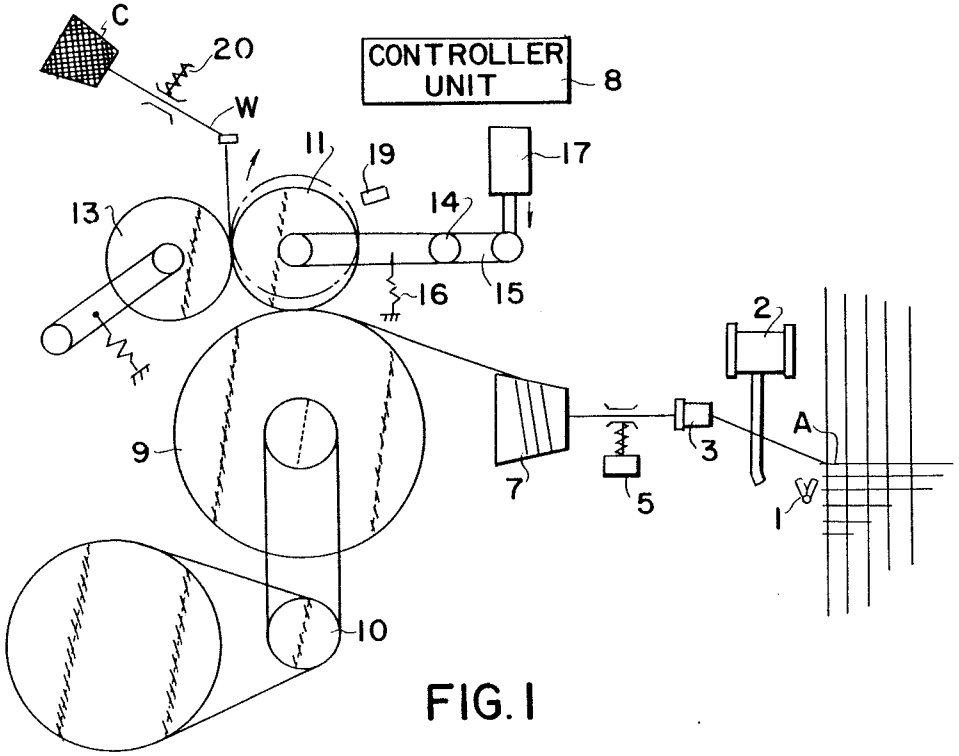
FIG. 1 is a diagrammatic front elevational view showing one embodiment of the apparatus for carrying out the method of the present invention.

It is to be understood that the sequence and timing of the operation of the disclosed components of the apparatus in accordance with the method of the present invention is achieved by a loom controller unit 8. The loom controller unit 8 may take the form of a variety of controllers known for the operation of looms. In the apparatus illustrated in FIG. 1, a rotary drum 7 is used for reservation of a sufficient quantity of weft for weft insertion into the shed of the loom by means of a main nozzle 3. When a stop signal is generated by means of the loom controller unit 8, a weft cutter 1 and a weft gripper 5 are temporarily rendered inactive in response to the stop signal so that the weft cutter 1 will not sever the weft extending between the main nozzle 3 and the shed A. In addition, the weft gripper 5 will continue to grip the weft on the upstream side of the main nozzle 3 in order to prevent the next weft insertion. The loom will come to a complete stop after about one cycle of inertia running.

The operation of the weft cutter 1 and the gripper 5 may be as evidenced from U.S. Pat. No. 4,502,512 which discloses one known way of operation of a weft cutter and weft gripper. Specifically, a faulty weft signal from a weft feeler is communicated to a solenoid so as to drive the solenoid for inactivating the movable blade of a weft cutter. Concurrently, operation of a clamper cam for the weft gripper is interrupted, the gripper thereby being left in a closed position to retain its grip on the weft. In order to reactivate the weft cutter, a signal from the controller unit 8 of the loom is communicated to the solenoid. This signal also cancels the interruption of the operation of the clamper cam of the weft strippers.

A weft measuring unit 12 includes a clutch 10, for example, as in U.S. Pat. No. 3,805,850, a drive roller 9 and a pair of nip rollers 11 and 13. After the complete stoppage of the loom, the clutch 10 is opened to temporarily inactivate the weft reservoir unit. Subsequently, the loom is rotated reversely to a crank position which allows for weft removal, i.e., usually a crank position of about 180 degrees. Reverse rotation of the loom after stoppage is carried out in the following manner. Upon detection of the fault weft signal from the weft feeler, the drive motor of the loom is stopped and weft insertion, i.e., warp supply and warp take-up, are subsequently stopped. The drive motor of the loom is then driven for reverse rotation in order to open the shed holding the faulty weft. Concurrently, the warp supply and warp take-up are driven for reverse rotation so that the cloth-fell of the shed of the faulty weft is brought to a standard position by rearward movement of the warp sheet. Thereafter, the gripper 5 is activated so as to open and release the weft at a location between the main nozzle 3 and weft reservoir 7.

The nip roller 11 is subsequently released from pressure contact with the drive roller 9. At this time, a faulty weft removing unit 2 is operated for removal of the faulty weft from shed A.

Release of the nip roller 11 from pressure contact with the drive roller 9 is achieved by a swingable lever 15 pivoted to a fixed pin 14 and carrying the nip roller 11 at one end thereof. A compression spring 16 is attached to the lever 15 in order to keep pressure contact between the rollers 9 and 11. The other end of the lever 15 is placed in engagement with the rod of a piston 17. As the piston 17 operates to advance the rod, the lever 15 is forced to swing clockwise in FIG. 1 against the spring force in order to bring the nip roller 11 to a position shown by the dashed line, i.e., out of contact with drive roller 9. The faulty weft signal is again used for control of the nip roller 11. Upon detection of a faulty weft signal, a solenoid or the piston 17 is driven into operation. Concurrently with this operation, the clutch 10 is driven to disconnect the connection between the drive roller 9 and the main shaft of the loom, thereby provisionally inactivating the measuring function of the weft measuring unit.

With the nip roller 11 out of contact with the drive roller 9, removal of a faulty weft from the shed A by the weft removing unit 2 also extracts the residual weft on the weft reservoir 7. It is to be understood that the faulty weft signal is communicated to the removing unit 2. Concurrently, the loom is rotated in reverse to open the shed holding the faulty weft so that the removing unit 2 can remove the faulty weft from the open shed. After complete removal of the faulty weft, the removing unit automatically terminates its operation. If there is no interruption in weft supply, for example, no breakage of the weft between the weft removal unit 2 and weft supply C, this extraction causes corresponding rotation of the nip roller 11 due to its contact with the weft. When there is interruption in the weft supply, there is no extraction of weft from the weft supply and there is no rotation of the nip roller 11. Thus, rotation of the nip roller 11 can be used as an index of the presence of no interruption in weft supply.

To this end, a rotation detector 19 is arranged adjacent to and facing the surface of the nip roller 11. The rotation detector 19 generates a detection signal when the nip roller 11 rotates upon separation from the drive roller 9. When the residual weft is completely delivered upon removal of the faulty weft, the weft from the supply source C is directly connected to the main nozzle 3 only near the nip roller 11. If the nip roller 11 rotates under this condition, the rotation indicates absence of any breakage of the weft. Subsequently, a corresponding signal is generated by detector 19 to activate restart on the loom. Restart of the loom is effected in response to the presence of a detection signal by rotation detector 19. In the absence of the interruption in weft supply upon removal of the faulty weft, a weft W is removed from weft supply source C via a tensioner 20, thereby rotating the nip roller 11 for sensing by the rotation detector 19 and the generation of the detection signal. The tensioner is constantly spring loaded to keep a constant tension on the weft supply to rollers 11, 13, and 19. Restart of the loom can be carried out in the absence of trouble since there is no interruption in the weft supply.

When no detection signal is generated by the rotation detector 19 at a prescribed moment after initiation of removal of the faulty weft by the weft removal unit 2, removal of the faulty weft is interrupted and restart of the loom is prevented. The above-described prescribed moment can be set as desire by proper adjustment of a timer (not shown) with reference to the width of the cloth under production and the operating speed of the faulty weft removing unit 2. Usually, removal of the faulty weft has been completed and the weft is just taken out from the weft supply source at the above-described prescribed moment.

Confirmation of the presence of the interruption in weft supply may also be performed during a period before the above-described prescribed moment. In this case, there is the possibility that, after short generation of a detection signal, another interruption of weft supply may appear for some reason. In order to obviate this problem, the apparatus can be preferably designed such that the loom can be restarted only when a series of detection signals have been generated in succession during the period. Before restarting the loom after complete removal of the faulty weft, the piston 17 is driven to pull back the rod, whereupon the nip roller 11 is placed into pressure contact with the drive roller 9 due to the spring force. Finally, the clutch 10 is closed.

Any type of rotation detector may be employed as long as it correctly senses rotation of the nip roller 11. Further, various different systems are employable for causing swing movement of the lever 15. The manner of confirmation of the presence of no interruption in the weft supply is not limited to detection of the rotation of the nip roller 11. For example, movement of the weft W removed from the weft supply source C may be detected by a piezo-electric or photo-electric sensor.

Figure 2:
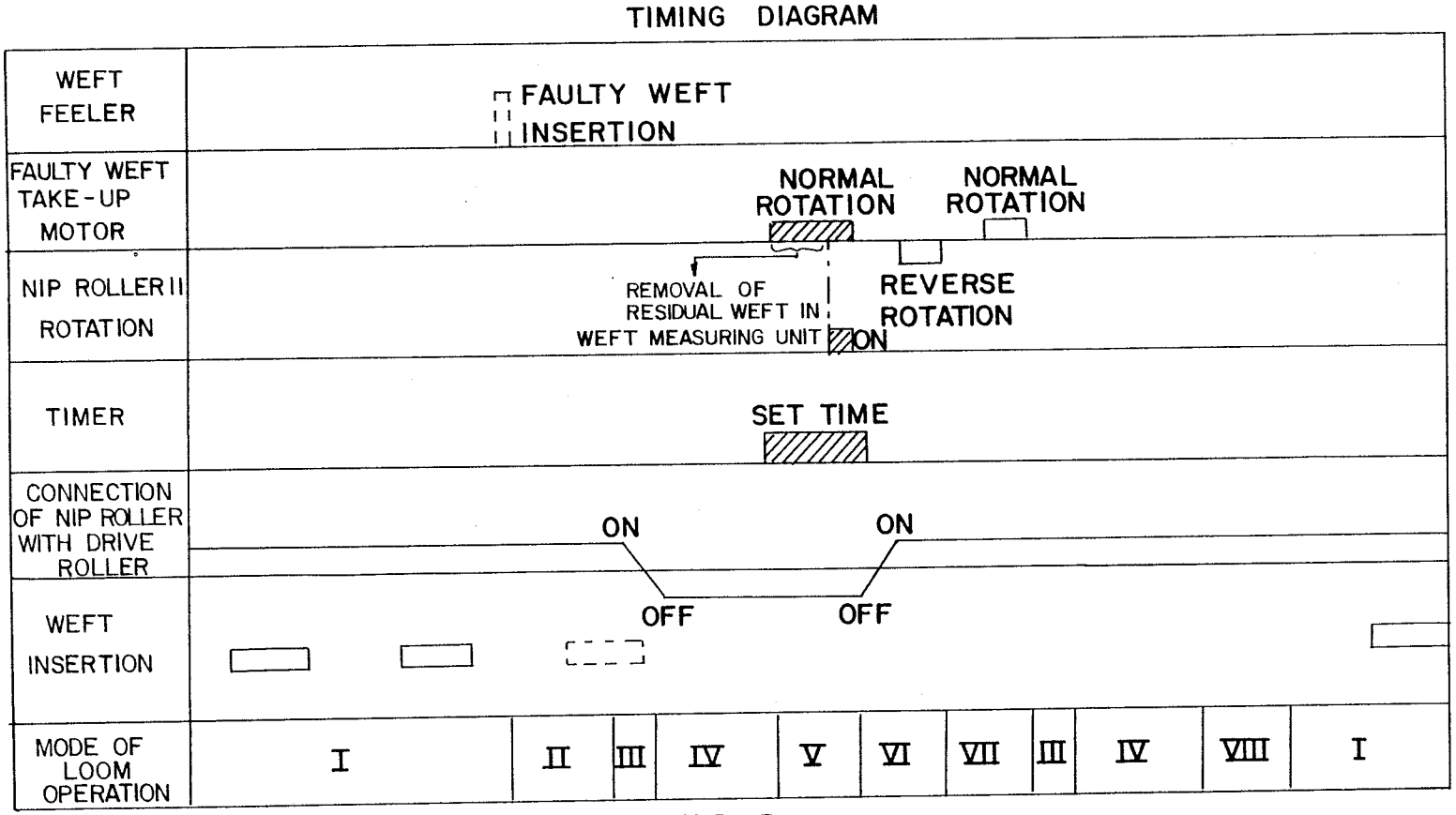
FIG. 2 is a timing diagram for the apparatus embodying the method of the present invention.

The relationship between the sequential operations of the apparatus in accordance with the method of the present invention and the loom operation is diagrammatically illustrated in FIG. 2. By way of explanation, I indicates normal rotation, II indicates braking and stoppage at a prescribed angle, III indicates preparation for reverse rotation, IV indicates one cycle reverse rotation and stoppage at a prescribed angle, V indicates take-off of a faulty weft, VI indicates cutting of a faulty weft, VII indicates removal of a faulty weft, and VII indicates preparation for normal rotation.

In addition to the rotary drum type weft reservoir 7 shown in the drawing, the present invention may also use a fixed drum type (not shown) or pneumatic type weft reservoir (not shown). When applied to a fixed drum type weft reservoir, a control pin engageable with a weft is temporarily made inactive to release the weft during removal of a faulty weft and to enable delivery of the weft from the weft supply source. Movement of the weft during this delivery is detected to confirm the presence of no interruption in the weft supply.

In accordance with the present invention, a loom is restarted only after absence of interruption in the weft supply has been confirmed so that no stoppage of the loom will reoccur just after restart. In the case of a rotary drum type weft reservoir, presence of a residual weft is confirmed before restarting of the loom so that a weft of a correct length will always be used for the next weft insertion.

Although the invention herein has been described with references to particular embodiments, it is to be understood that these embodiments are merely illustrative of the principles and application of the present invention. It is therefore to be understood that numerous modifications may be made to the embodiments and that other arrangements may be devised without departing from the spirit and scope of the present invention as defined by the dependent claims.

What is claimed is:

1. In a method of removing a faulty weft from a shed of a jet loom upon stoppage of the loom and of restarting the loom thereafter; the loom having a supply source of weft to be delivered therefrom, a main nozzle for inserting the weft delivered from the supply source into the shed, and a weft removal unit for removing a faulty weft from the shed upon activation thereof prior to severing the faulty weft from the supply source, the improvement comprising:

generating a detection signal upon detecting the presence of the delivery of the weft from the supply source upon removal of the faulty weft from the shed upon activation of the weft removal unit, and allowing restarting of the loom after complete removal of the faulty weft from the shed and upon confirming the presence of the detection signal.

2. Method as claimed in claim 1, wherein said loom is restarted when the presence of a detection signal is confirmed at a prescribed moment after initiation of the removal of said faulty weft.

3. Method as claimed in claim 1, wherein said loom is restarted when the presence of a series of successive detection signals is confirmed within a period before a prescribed moment after initiation of said faulty weft.

4. Method as claimed in claim 1, further including temporarily inactivating a weft measuring unit before detection of the delivery of said weft from said supply source.

5. Method as claimed in claim 4, wherein the detection of the delivery of said weft from said supply source is accomplished by directly detecting axial movement of said weft.

6. Method as claimed in claim 4, wherein the detection of the delivery of said weft from said supply source is accomplished by detecting rotation of a nip roller arranged in engagement with said weft of said weft measuring unit.

7. Method as claimed in claim 1, further including releasing said weft at a position between said main nozzle and said supply source when removing the faulty weft from the shed to allow delivery of the weft from the supply source.

8. In an apparatus for removing a faulty weft from a shed of a jet loom upon stoppage of the loom and for restarting the loom thereafter; the loom having a supply source of weft to be delivered therefrom, a main nozzle for inserting the weft delivered from the supply source into the shed, and a weft removal unit for removing a faulty weft from the shed upon activation thereof prior to severing the faulty weft form the supply source, the improvement comprising:

means for generating a detection signal upon detecting the presence of the delivery of the weft from the supply source upon removal of the faulty weft from the shed upon activation of the weft removal unit, and means for allowing restarting of the loom after complete removal of the faulty weft from the shed upon confirming the presence of the detection signal.

9. Apparatus as claimed in claim 8, further including means for releasing said weft at a position between said main nozzle and said supply source when removing the faulty weft from the shed to allow delivery of the weft from the supply source.

10. Apparatus as claimed in claim 8 wherein said means for generating a detection signal comprises means for directly detecting axial movement of said weft.

11. Apparatus as claimed in claim 8, wherein said means for generating a detection signal comprises means for detecting rotation of a nip roller arranged in engagement with said weft.

* * * * *